US008726456B2

(12) United States Patent
Campbell

(10) Patent No.: US 8,726,456 B2
(45) Date of Patent: May 20, 2014

(54) VACUUM ASSISTED CONTAINMENT CLEANING

(76) Inventor: Keith S. Campbell, East Kingston, NH (US)

( * ) Notice: Subject to any disclaimer, the term of this patent is extended or adjusted under 35 U.S.C. 154(b) by 23 days.

(21) Appl. No.: 13/407,123

(22) Filed: Feb. 28, 2012

(65) Prior Publication Data

US 2013/0219651 A1 Aug. 29, 2013

(51) Int. Cl.
*A47L 9/02* (2006.01)
*A47L 7/00* (2006.01)

(52) U.S. Cl.
USPC ..... 15/321; 15/322

(58) Field of Classification Search
USPC ..... 15/320–322, 394, 414, 415.1, 416
See application file for complete search history.

(56) References Cited

U.S. PATENT DOCUMENTS

| | | | | |
|---|---|---|---|---|
| 2,789,307 | A * | 4/1957 | Sussman et al. | 15/394 |
| 3,774,262 | A * | 11/1973 | Anthony et al. | 15/322 |
| 5,400,468 | A * | 3/1995 | De Petra | 15/394 |
| 5,752,289 | A * | 5/1998 | Collins | 15/421 |
| 6,052,861 | A * | 4/2000 | Keller | 15/321 |
| 7,194,783 | B1 * | 3/2007 | Hunt | 15/321 |
| 7,272,869 | B1 * | 9/2007 | Robinson | 15/320 |
| 2009/0133721 | A1 | 5/2009 | Campbell | |

FOREIGN PATENT DOCUMENTS

| | | |
|---|---|---|
| EP | 0038724 | 10/1981 |
| JP | 2545048 | 5/1997 |
| JP | 2003-245613 | 9/2003 |
| WO | WO2011159990 A2 | 12/2011 |

OTHER PUBLICATIONS

PCT International Search Report and Written Opinion. Jun. 18, 2013.

* cited by examiner

*Primary Examiner* — Mark Spisich
*Assistant Examiner* — Andrew A Horton
(74) *Attorney, Agent, or Firm* — Ronald E. Smith; Smith & Hopen, P.A.

(57) ABSTRACT

An apparatus for cleaning a chandelier includes a hand-held cleaning head formed by a first and second section joined to one another at a common base and transversely spaced apart from one another as they extend from the base to define a cleaning chamber between them. The cleaning chamber has an open top, an open bottom, and an open end so that a string of chandelier crystals may be positioned within the cleaning chamber. A hot water-spraying nozzle is formed in the cleaning head. The cleaning chamber is in fluid communication with a remote vacuum source and a remote source of hot water and hot air under positive pressure. Crystals disposed within the cleaning chamber are cleaned by hot water from the water-spaying nozzle and the vacuum pulls ambient air and dirt to the source of negative pressure. The crystals are dried by ambient air and the hot air.

14 Claims, 5 Drawing Sheets

VACUUM ASSISTED CONTAINMENT CLEANING

BACKGROUND OF THE INVENTION

1. Field of the Invention

This invention relates to methods and apparatus for cleaning chandeliers. More specifically, it relates to a hand-held, hot water and vacuum device that cleans single crystals or individual strands of crystals at a high rate of speed.

2. Brief Description of the Related Art

The conventional wisdom has long been that chemicals are needed when chandeliers are cleaned. Recent studies by this inventor have shown, however, that applying a hot water spray to chandelier crystals, followed by application of dry air, does the job without chemicals.

Tents have been built around chandeliers to catch the water to protect the area around the chandelier, including the floor below, as water is sprayed onto the crystals and to catch water as it drips from the crystals. Access openings have to be built into the tent. Moreover, the tent must be raised into position and lowered after the work is done.

Thus there is a need for a hot water and dry air chandelier cleaning method that does not require tenting of the chandelier.

However, in view of the art considered as a whole at the time the present invention was made, it was not obvious to those of ordinary skill in the field of this invention how hot water and dry air could be applied to the crystals of a chandelier in the absence of a tent.

BRIEF SUMMARY OF THE INVENTION

The long-standing but heretofore unfulfilled need for a chandelier cleaning apparatus and method that is free of chemicals and which requires only hot water and air is now met by a new, useful, and nonobvious invention.

The novel apparatus includes a cleaning head adapted to be held by a single hand. The cleaning head has a bifurcated construction that includes first and second sections that are joined to one another at a common, proximal base and which are transversely spaced apart from one another at a distal end thereof. The transverse spacing defines a cleaning chamber between the first and second sections.

The cleaning chamber has an open top, an open bottom, and an open distal end so that a string of chandelier crystals may be positioned within the cleaning chamber, i.e., between the first and second sections. At least one water-spraying nozzle is formed in the cleaning head and is in fluid communication with a remote source of hot water under pressure. This hot water under pressure is the only cleaning agent required.

The cleaning chamber is also in fluid communication with a remote source of hot air under pressure and with a remote source of negative pressure so that a vacuum is created in the cleaning chamber. The provision of both hot air to the cleaning chamber as well as a vacuum is accomplished by an elongate vacuum tube that has a divider wall in its lumen so that air flows from the cleaning chamber to a remote vacuum source on a first side of the divider wall and hot air from a remote hot air source flows to the cleaning chamber on a second side of the divider wall.

The crystals disposed within the cleaning chamber are cleaned by hot water emitted from the at least one water-spaying nozzle as aforesaid. The vacuum pulls ambient air, the hot air from the hot air source, the hot water that has been sprayed onto the crystals, and dirt as well as dust removed from the crystals to the source of negative pressure. The ambient air, together with the hot air under pressure, provides a quick drying effect to the crystals.

The cleaning head can be held by a human hand or a robotic hand.

The remote source of negative pressure and hot water is a double-chambered container having a divider wall that divides the container into a vacuum chamber on a first side of the divider wall and a hot water chamber on a second side of the divider wall. The remote source of hot air under pressure is a hot air blower mounted on the hot water chamber.

A motor-driven vacuum pump that discharges air into ambient atmosphere external to the double-chambered container through a one-way vent is positioned in the vacuum chamber. An elongate vacuum hose has a first end in open fluid communication with an interior of the vacuum chamber and a second end in open fluid communication with a hollow handle to which is swivelly mounted the proximal end of the hand-held cleaning head.

The hot water chamber is partially filled with water and a heating element is submerged in the water to regulate water temperature. A pump having a water inlet and a water outlet is submerged in the water. A hot water supply conduit has a first, proximal end in fluid communication with the pump outlet and a second, distal end in fluid communication with at least one water-spraying nozzle formed in the hand-held cleaning head. A water return conduit has a second, distal end in fluid communication with the cleaning chamber and a first, proximal end in fluid communication with the interior of the vacuum chamber.

The divider wall in the lumen of the vacuum hose is provided in the part thereof that is external to the double-chambered container. A hot air hose has a proximal end in communication with a hot air blower mounted atop the hot water chamber and a distal end that merges with the vacuum hose at a point thereof that is external to the double-chambered container. The point of merger is at the beginning or proximal end of the divider wall in the lumen.

Accordingly, both the vacuum side of the divider wall and the hot air side of the divider wall are in open fluid communication with the cleaning chamber at their respective distal ends so that hot air under positive pressure is introduced into the cleaning chamber, helping to dry the crystals, and then withdrawn therefrom by the vacuum. Ambient air is drawn into the cleaning chamber, into the vacuum side of the divider wall, and hence into the vacuum chamber, further drying the crystals.

The crystals, when disposed in the cleaning chamber, are first impacted with hot water under pressure emitted from the at least one water-spraying nozzle and secondly with hot air from the hot air blower. The operator pushes a first button a first time to activate the hot water spray and pushes the first button a second time to stop the hot water spray. The operator then pushes a second button a first time to activate the hot air flow and pushes the second button a second time to stop the hot air flow. Thus, both the sequence and duration of the hot water and hot air applications are under the control of the operator. The vacuum flow is continuous so the operator need not start and stop such flow.

An imperforate vacuum-increasing wall is removably mounted between the first and second sections of the cleaning head to cause ambient air flowing into the cleaning chamber to flow at a higher rate relative to an ambient air flow rate when no imperforate wall is positioned between the sections. This enhances the crystal-drying process.

A rounded lip is disposed about a peripheral edge of each of the sections so that each crystal contacting a rounded lip is further dried as water on each crystal is wicked onto the rounded lip.

The primary objects or advantages of the invention are to provide a chandelier cleaning apparatus and method that can be used to clean articles other than chandeliers as well, that can be held by a human hand or a robotic hand, that uses hot water only, with soap application optional, that does not drip water so that towels, tarps or tents are not needed, that enables the cleaning of up to twenty-five hundred (2500) crystals in half a minute, that dries the crystals spotlessly as soon as they are cleaned, and that otherwise advances the technology of cleaning in general by harnessing the power of hot water, hot air, and a vacuum in a way that was heretofore unknown.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1A:
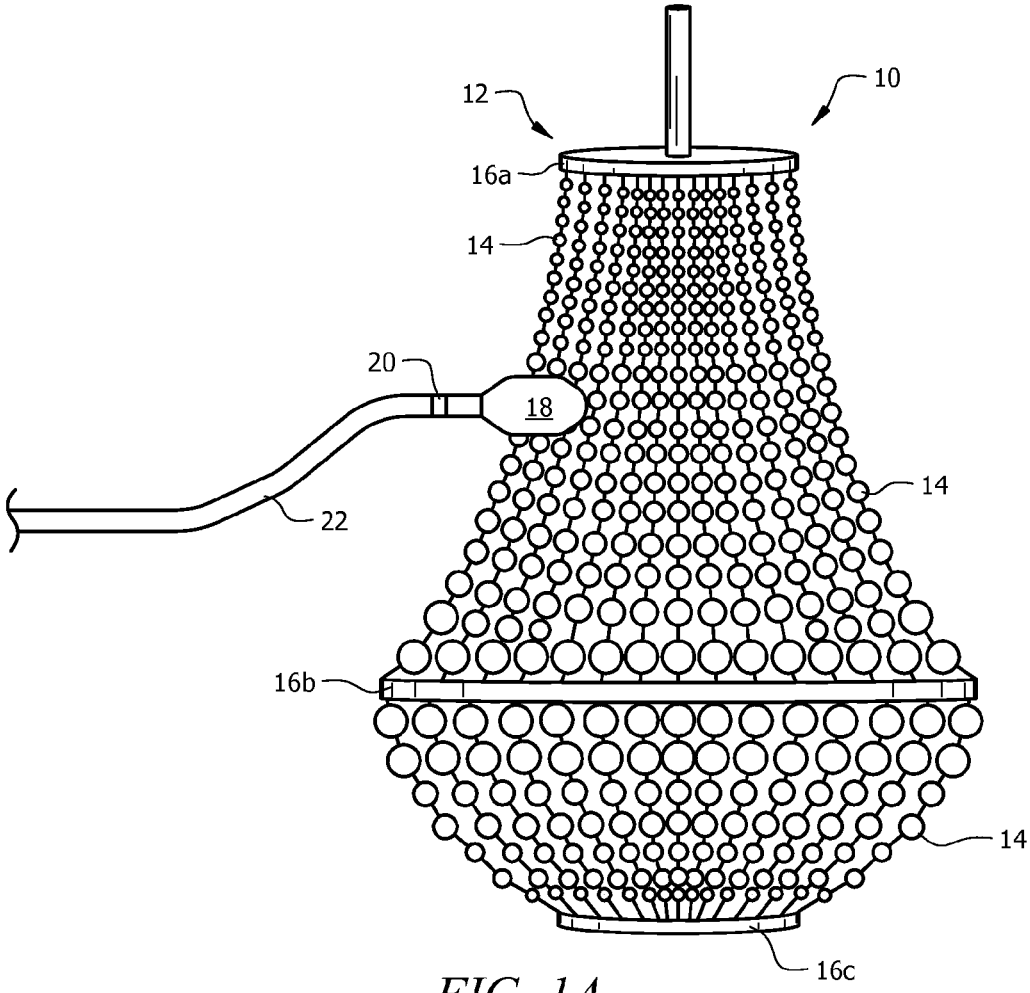
FIG. 1A is a perspective view of a chandelier, the novel cleaning head and a vacuum hose connected to the cleaning head.
Figure 1B:
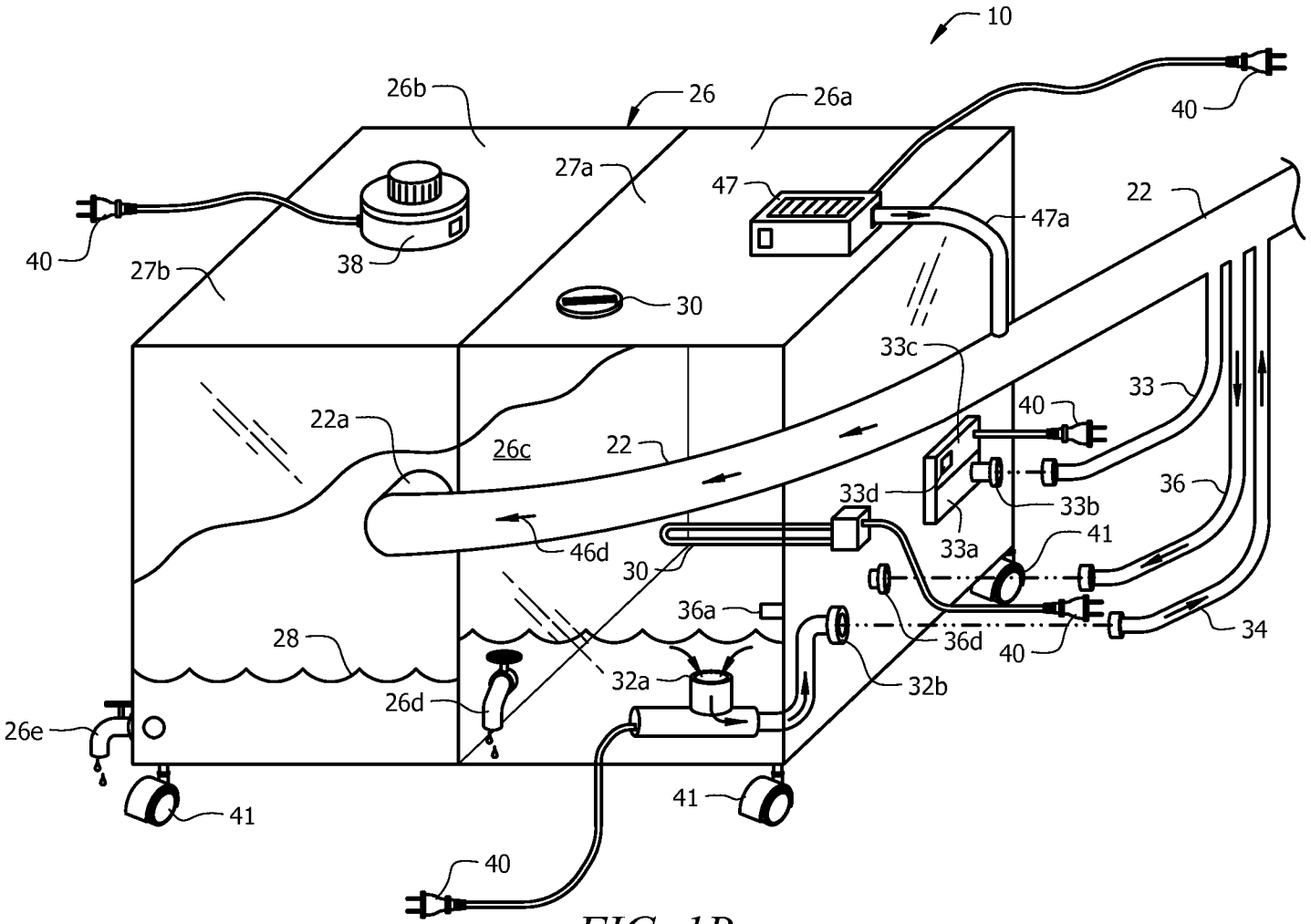
FIG. 1B is a perspective view, enlarged with respect to FIG. 1A as indicated by the increase in diameter of the vacuum hose, of the remaining parts of the novel assembly.

The novel apparatus is denoted as a whole in FIGS. 1A and 1B by the reference numeral 10. FIG. 1B is enlarged with respect to FIG. 1A as indicated by the increased diameter of vacuum hose 22.

As depicted in FIG. 1A, chandelier 12 in this illustrative embodiment is formed by a first plurality of crystal jewels, collectively denoted 14, that extend from upper mounting ring 16*a* to middle mounting ring 16*b*. A second plurality of crystal jewels 14 extends from middle mounting ring 16*b* to lower mounting ring 16*c*. There are many other arrangements of crystals and mounting rings that may collectively form a chandelier. This invention has utility in connection with the depicted exemplary embodiment and all other designs as well.

Novel cleaning head 18 is held by a single hand throughout the entire cleaning process. Although depicted as being oval in shape, it can be provided in rectangular, square, or many other geometrical configurations. It includes hollow handle 20 to which a second, distal end of elongate vacuum hose 22 is attached.

As depicted in FIG. 1B, double-chambered container 26 is partitioned into hot water chamber 26*a* and dirty water and vacuum chamber 26*b* by vertical divider wall 26*c*.

The proximal end of vacuum hose 22 is in fluid communication with vacuum chamber 26*b*. More particularly, vacuum hose 22 extends around container 26, externally thereof, and terminates at port 22*a* that is in fluid communication with said vacuum chamber.

Figure 5:
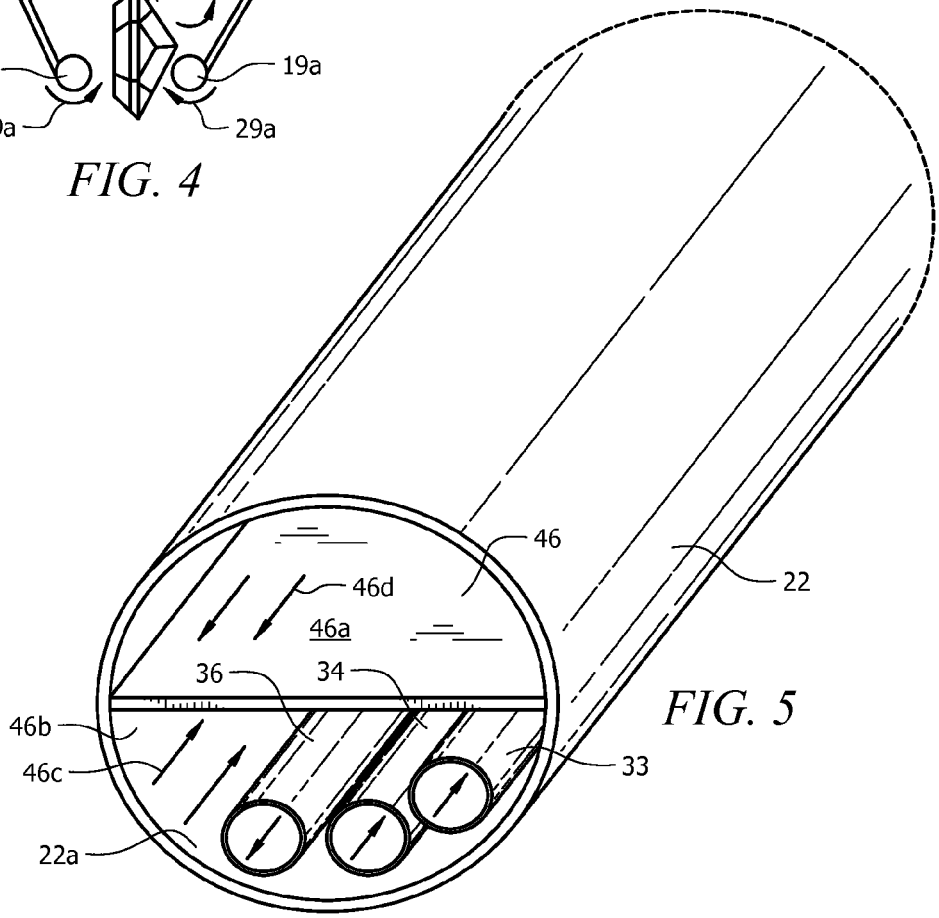
FIG. 5 is a cross-sectional view of the vacuum tube.

As depicted in FIG. 5, lumen 22*a* of vacuum hose 22 is divided by divider wall 46 into first and second sub-lumens 46*a*, 46*b*. Air from cleaning head 18 is drawn under vacuum in first sub-lumen 46*a* to vacuum chamber 26*b* as indicated by directional arrows 46*d*. Some dirty water will also accumulate in vacuum chamber 26*b* as indicated by water level 28 in FIG. 1B. Hot air under positive pressure created by hot air blower 47 flows to cleaning head 18 through conduit 47*a* which is in fluid communication with said second sub-lumen 46*b*, said flow being indicated by directional arrows 46*c*.

As also depicted in FIG. 5, hot water conduit 34 carries hot water from hot water chamber 26*a* to cleaning head 18 and is also positioned in second sub-lumen 46*b*, as is return hot water conduit 36 that extends from cleaning head 18 to the interior of hot water chamber 26*a*. As an alternative embodiment, soap application tube 33 may also be positioned within said second sub-lumen.

As depicted in FIG. 1B, hot water chamber 26*a* is partially filled with water 28 through port 30 formed in top wall 27*a* of double-chambered container 26. Port 30 provides a water fill opening and includes valve means to seal hot water chamber 26*a*.

Water in hot water chamber 26*a* is heated by heater element 30 which is submerged within said water. The temperature of the hot water is therefore sustainable. It thus differs from the hot water created by ultrasound which cools down after one dip, i.e., when a crystal is submerged in an ultrasound vessel, it acts like an ice cube that is dipped in and out of a body of water, cooling the water upon each dip.

Pump 32 having water inlet 32*a* may be mounted outside container 26 or it may be submerged as depicted. The proximal end of hot water supply conduit 34 is releasably coupled to discharge port 32*b* of pump 32 and follows a path of travel from said discharge port to sub-lumen 46*b* as aforesaid and terminates in hot water spray nozzle 42.

Return water conduit 36, also depicted in FIG. 5, follows a reverse path of travel, extending from cleaning head 18, through the lumen of hollow handle 20, and into sub-lumen 46*b* of vacuum hose 22. Its proximal end is releasably coupled to port 36*b* that is in fluid communication with tube 36*a* which extends into hot water chamber 26*a*. Continuous operation of pump 32 thus circulates hot water to cleaning head 18. Hot air blower 47, mentioned above, is preferably mounted to top wall 27*a* of container 26 and blows hot air under positive pressure through hot air tube 47*a* to sub-lumen 46*b* of vacuum tube 22 as aforesaid. Hot air blower 47 may be mounted at other locations as well. The mounting position is selected to minimize the length of hot air tube 47*a*.

The vacuum is maintained in dirty water and vacuum chamber 26*b* of double-chambered container 26 by a vacuum motor disposed in housing 38 mounted on top wall 27*b* of said double-chambered container 26. Electrical leads, collectively denoted 40, provide electrical communication from a remote source of power to heating element 30, water pump 32, said vacuum motor and to hot air blower 47. Said remote source of power is also in electrical communication with a motor that operates a pump in a soap tank if that auxiliary feature is added to the inventive structure.

Wheels 41 facilitate movement of double-chambered container 26 over a support surface so that it can be moved as needed to avoid wrapping vacuum hose 22 around chandelier 10 as the cleaning process is performed. Drain 26*d* enables draining of water from hot water chamber 26*a* and drain 26*e* enables draining of dirty water from dirty water and vacuum chamber 26*b*.

Figure 2:
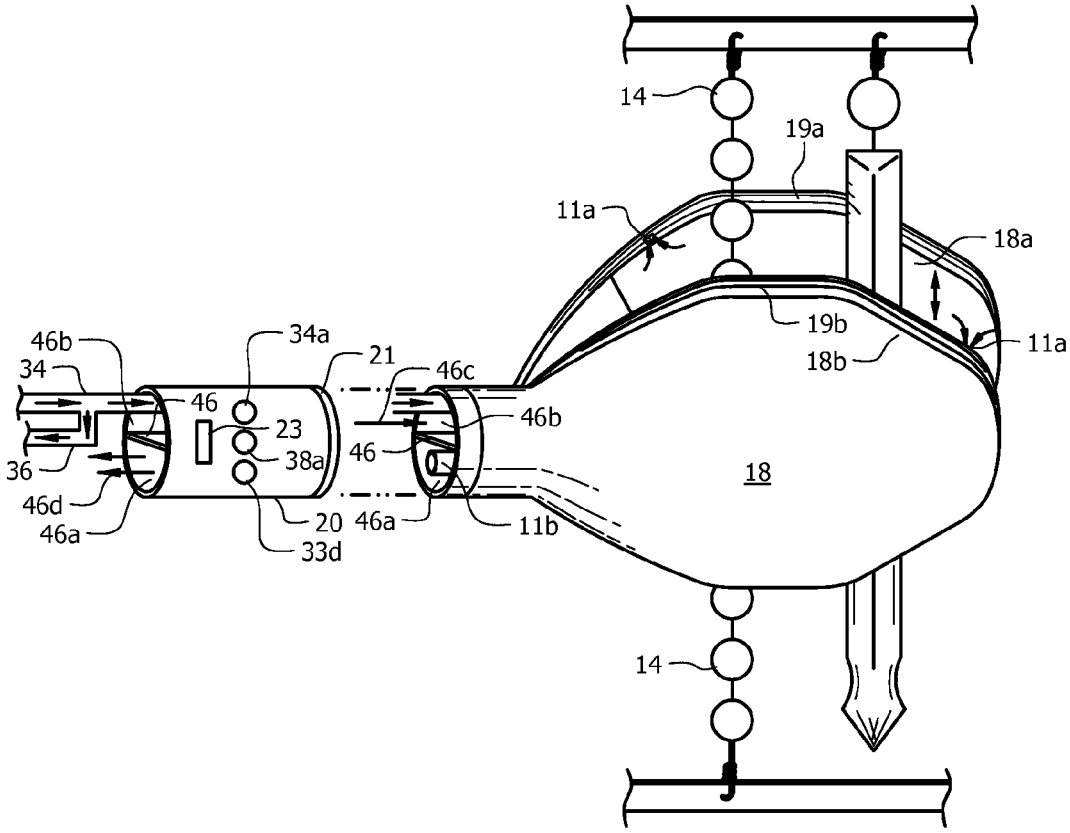
FIG. 2 is an exploded perspective view of the novel cleaning head.

FIG. 2 is an exploded perspective view of cleaning head 18 and hollow handle 20. Swivel 21 enables relative rotation between cleaning head 18 and hollow handle 20.

Cleaning head 18 is bifurcated, having first and second sections 18*a* and 18*b* that are joined at their proximal ends to a common base and transversely spaced apart from one another at their respective distal ends by a distance sufficient to create a cleaning chamber that is of ample volume for the reception of a string of crystals 14 therebetween as depicted. Rounded lip 19*a*, 19*b* borders each section 18*a*, 18*b*. i.e., rounded lip 19*a* completely encircles the periphery of section 18*a* and rounded lip 19*b* completely encircles the periphery of section 18*b*.

Crystals 14, when disposed between sections 18*a* and 18*b* as depicted, are impacted first with hot water and secondly with hot air under pressure. A first actuation of switch 34*a* opens hot water supply conduit 34 and a second actuation of said switch closes said conduit 34. A first actuation of switch 38*a* actuates hot air blower 47 and a second actuation of said switch stops said hot air blower. The space between cleaning head parts 18*a*, 18*b* is also in open communication with hot water return conduit 36 positioned within sub-lumen 46*b* of vacuum hose 22 so that hot water, after impacting the crystals, is returned to hot water chamber 26*a*. The hot air, after enhancing the crystal drying process, is drawn into vacuum chamber 26*b* through sub-lumen 46*a* as indicated in FIG. 5 by directional arrows 46*d* as mentioned above. The hot water and the hot air carry dirt or dust removed from the crystals to chambers 26*a* and 26*b*, respectively.

Soap may be added to the hot water as an option and may be needed to clean for the first time a chandelier normally cleaned with conventional chemicals. Optional soap tube 33 is depicted in FIGS. 1B, 2 and 5. As depicted in FIG. 1B, soap tube 33 is releasably coupled to port 33*b* of soap pump 33*a* that is in fluid communication with soap tank 33*c*. An operator may press start/stop button 33*d* (FIG. 1B) to commence or terminate operation of soap pump 33*a*. A second soap pump start/stop button is also denoted 33*d* in FIG. 2 and it should be understood that both buttons perform the same function and have two locations for the convenience of the operator. Button 34*a* (FIG. 2) starts and stops hot water pump 32 and button 38*a* (FIG. 2) starts and stops hot air blower 47 as aforesaid.

Water flow through hot water supply conduit 34 is regulated or throttled by regulator valve 23 (FIG. 2), i.e., the flow rate of water increases as regulator 23 is opened and decreases as said regulator is closed.

Figure 3:
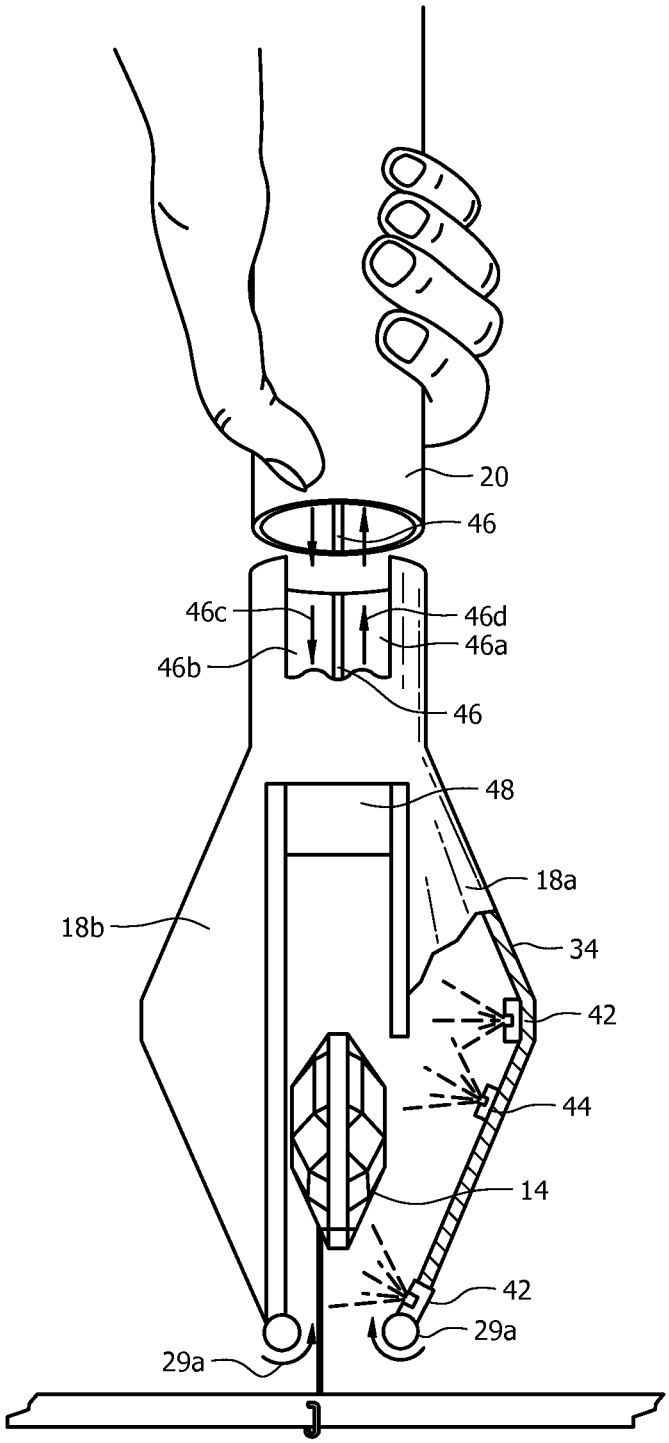
FIG. 3 is a top plan view of the structure depicted in FIG. 2.

As best understood in connection with FIGS. 2 and 3, hot water supply conduit 34 is in fluid communication with at least one hot water jet nozzle 42 formed in cleaning head 18 and soap tube 33 is in fluid communication with soap nozzle 44, both nozzles being formed in both housing sections 18*a* or 18*b* or just one of them. The jet nozzles preferably include fan spray heads for complete coverage. When no soap is required, soap switch actuator 33*d* is placed into its "off" or "closed" position.

Accordingly, crystals 14 are cleaned with hot water under pressure supplied by water pump 32, with or without soap. Since the crystals are cleaned with hot water and no chemicals, use of the novel system will not degrade or discolor glue or adhesives holding the crystals together on the frame. Nor will use of the novel system discolor pins or connectors as chemical cleaners do.

Divider wall 46 also extends into hollow handle 20 and base 18*c* of cleaning head 18 as depicted in FIGS. 2 and 3.

Warm air from hot air blower 47 flows into the space between parts 18*a*, 18*b* on hot air side 46*b* of baffle wall 46 as indicated by directional arrows 46*c* to dry the crystals. The hot air is then drawn into vacuum and dirty water chamber 26*b* by the vacuum therewithin as indicated by directional arrows 46*d* on the opposite side 46*a* of baffle wall 46 as aforesaid.

Imperforate vacuum-increasing sidewalls 48 may be removably inserted between sections 18*a*, 18*b* to perform the function their name implies. By decreasing the size of the opening between said sections, ambient air is drawn in by the vacuum within vacuum chamber 26*b* at a faster rate, thereby decreasing the drying time. The removable sidewalls that decrease the opening size and thus effectively increase the vacuum may be provided in snap on form.

Sipper intake openings 11*a* are formed in rounded lip 19*a*. Each opening 11*a* is the leading end of a bifurcated sipper tube having a trailing end 11*b* (FIG. 2) that is in fluid communication with vacuum chamber 26*b* of double-chambered container 26. The vacuum pulls water into cleaning head 18. The water collects and pools inside said cleaning head. Sipper intake openings 11*a* remove that water and thus help with the dirt and dust extraction process. The sipper tube improves the wicking process as well.

Figure 4:
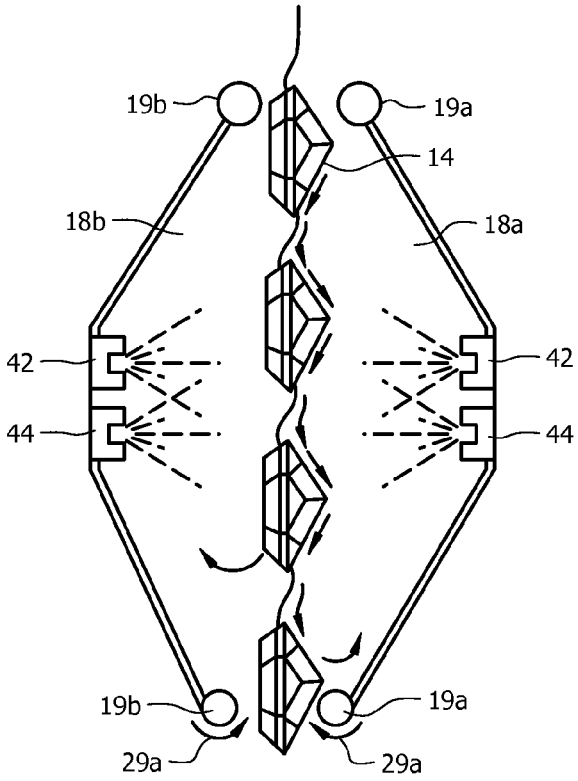
FIG. 4 is an end view of said structure.

FIG. 4 provides an end view of vacuum head 18 and this view perhaps best discloses the function of rounded lips 19*a*, 19*b* that encircle sections 18*a*, 18*b* at their respective peripheral edges. Each crystal 14 comes into contact with a rounded lip 19*a* or 19*b* as cleaner head 18 is used, and such contact wicks water from the crystal so that the inward flow of ambient air, indicated by directional arrows 29*a* at the bottom of FIGS. 3 and 4, completes the drying of each crystal. The inflowing ambient air also keeps rounded lips 19*a*, 19*b* dry.

The vacuum not only dries water from the crystal and pulls that water back into vacuum chamber 26*b*, it also removes dust from the crystal as well and pulls the dust into the vacuum chamber.

The novel apparatus thus cleans objects such as beaded chains and hanging crystals in place, i.e., there is no need to disassemble the chandelier. Nor does the apparatus require a tented enclosure such as a bag or tarp because the vacuum of the novel system pulls and removes water horizontally and vertically and is not dependent upon gravity. Water does not drip from cleaning head 18 or crystals 14 after said crystals have contacted lips 19*a*, 19*b*, thereby eliminating the need for tents, tarps, or towels.

Cleaning head 18 is best held with only one hand. Tests performed on crystal chains resulted in approximately twenty five hundred (2,500) crystals cleaned in thirty (30) seconds. The system removes dust and dirt where fingers and cloths can not reach. The system also cleans and removes dirty water that has pooled and dried from previous prior art cleanings. The system prevents, cracking, bending, re-bending, and breaking of wires holding beaded chains together. The system prevents stretching of wires caused by pulling on the beads while hand cleaning each bead of crystal in the course of a prior art cleaning Snagging on the metal wire ends with a cloth is also eliminated.

The novel method uses hot mist and vacuum to capture and remove dirty (contaminated) water in any direction, both horizontal and vertical. Moreover, it does not depend on gravity to remove drips from crystals.

The system uses adjustable flow and directional jets 42, 44 in conjunction with a vacuum. The system can also use air blowing on one side in a positive flow with the crystal in the middle and a negative vacuum on the opposite side.

The novel system can apply a proprietary soap that includes a polymer to help with rinsing that is applied within a vacuum. This helps with the drying in the hand-held part of the apparatus. The soap is applied from a jet or jets that form a part of the novel apparatus. The soap can be applied with the help of an electric pump option, hand-held pump, compressed air and soap mixture, etc. The force of the soap application loosens the dirt. Soap is applied if the chandelier or other item being cleaned has been neglected or has been improperly cleaned with prior art tools and methods. If soap is added to the novel system, it may or may not contact the metal chandelier body or frame but it is quickly rinsed off in either event.

The second step of the novel method is the rinse step that removes soap residue, if soap is used, with hot water under pressure and vacuum. This process is only used when chandeliers are neglected with years of dirt and dust build-up or when chemical sprays other than the novel system have been used. Chemical spray bottles leave residue and if not rinsed, lead to the deterioration of the lacquer finish protecting the metals.

The novel system when used frequently, after chemicals from previous methods (spray bottles) have been removed, approximately every 6-12 months, will not require soap and can be cleaned just using hot water, approximately 120°-160° F. and vacuum. This removes about ninety-nine percent (99%) of all airborne contaminants and is the preferred method of cleaning. Or, if the novel system is used on a new chandelier for the first cleaning and no chemical sprays have been used, a regular maintenance program every 6-12 months, hot water and vacuum is all that is needed. In this way, the novel system provides spotless cleaning, vacuum and drying.

The novel system may be enhanced by adding vacuum ports, steam, soap, mist, hot air, or air under positive pressure ports for enhanced drying.

The novel system is not limited to chandelier cleaning. It also has utility in connection with the cleaning of crystal figurines, artificial plants, or the like. The novel cleaning head can also be attached to a conventional spray bottle with or without a vacuum. However, a vacuum is preferred to limit dripping.

The novel system eliminates the prior art need to clamp around what is being cleaned. Nor does it require removal of the crystals from the chandelier, i.e., the crystals are cleaned in place, while still connected to the chandelier frame.

The cleaning head has three open sides to facilitate entry of a crystal chain into the cleaning chamber of the cleaning head. It eliminates dripping and the prior art need to unhook crystal chains that are attached on both ends as is common in chandeliers. The novel cleaning head enables one pass cleaning with two (2) jets or more. No known chandelier cleaning systems uses more than one jet spray head.

The device is simple and can be used by a robot to clean any chain length. A human operator can use a pole extension to clean hard-to-reach objects. Such extension members may be placed between vacuum hose 22 and hollow handle 20.

The novel system advantageously prevents dust from jumping from one side to the other on a crystal and from moving from one crystal to another as happens when the spray bottles of the prior art are used.

The novel system is chemical-free and is the only known cleaning system capable of removing chemicals applied by earlier cleaners.

Unlike the spray bottles of the prior art, the novel system provides one hundred percent (100%) coverage of crystals, both front and back.

The system is efficient. Accordingly, when the water is turned on and the crystals are hit with a mist of hot water, the only cleaning agent when soap is not used, the operator needs to make only one pass with the hand-held cleaning head over the length of the crystal disposed between the opposed sections of the hand-held cleaning head. When the water is turned off to dry a crystal and to remove dust, again only one pass is needed to complete the drying process. Said single pass with the mist turned off removes all water drops or droplets, drying the crystals without spotting.

Moreover, the structure and method of operation of cleaning head 18 prevents water from coming into contact with electrical areas of the chandelier.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

What is claimed is:

1. An apparatus for cleaning a chandelier, comprising:

a cleaning head adapted to be held by a single hand;

said cleaning head having a bifurcated construction that includes a first section and a second section;

said first and second sections being joined to one another at a common base and being transversely spaced apart from one another along respective lengths thereof;

said transverse spacing defining a cleaning chamber between said first and second sections;

said cleaning chamber having an open top, an open bottom, and an open end so that at least one chandelier crystal may be positioned within said cleaning chamber;

at least one water-spraying nozzle formed in said cleaning head;

said at least one water-spraying nozzle being in fluid communication with a remote source of water under pressure;

said cleaning chamber being in fluid communication with a remote source of negative pressure so that a vacuum is created in said cleaning chamber;

said at least one crystal disposed within said cleaning chamber being impacted by water under pressure emitted from said at least one water-spraying nozzle;

said vacuum pulling ambient air, water, dust and dirt removed from said at least one crystal to said source of negative pressure;

said ambient air providing a drying effect to said at least one crystal;

a double-chambered container having a dirty water and vacuum chamber and a water chamber that is not under vacuum;

a vacuum pump in fluid communication with said dirty water and vacuum chamber;

said water chamber having water disposed therein;

a hot air blower in fluid communication with said water chamber;

a water heating element submerged within said water in said water chamber and being operative to heat said water disposed in said water chamber;

a pump for pumping water from said water chamber to said at least one water-spraying nozzle.

2. The apparatus of claim 1, further comprising:

an elongate vacuum hose having a proximal end in fluid communication with said dirty water and vacuum chamber and a distal end in fluid communication with said cleaning head;

a divider wall positioned in a lumen of said elongate vacuum hose along its length, said divider wall dividing said lumen into a first sub-lumen in fluid communication with said dirty water and vacuum chamber and a second sub-lumen in fluid communication with said hot air blower;

said first sub-lumen being in open fluid communication with said cleaning chamber so that ambient air, hot water, dust and dirt removed from said at least one crystal is conveyed to said dirty water and vacuum chamber; and said second sub-lumen being in open fluid communication with said hot air blower so that hot air from said hot air blower travels through said second sub-lumen to said cleaning head to perform a drying function on said at least one crystal.

3. The apparatus of claim 2, further comprising:

a hot water supply conduit and a hot water return conduit being disposed in said second sub-lumen, said hot water supply conduit interconnecting hot water in said water chamber to said at least one water-spraying nozzle and said hot water return conduit interconnecting said cleaning chamber and said hot water chamber.

4. The apparatus of claim 2, further comprising:

a hollow handle attached to said cleaning head at said common base of said first and second sections of said cleaning head;

a first switch actuator positioned in said hollow handle, said first switch actuator being in electrical communication with said hot water pump so that an operator can start and stop hot water flow as needed during a chandelier cleaning procedure.

5. The apparatus of claim 4, further comprising:

a swivel for interconnecting said cleaning head to said hollow handle.

6. The apparatus of claim 4, further comprising:

a second switch actuator positioned in said hollow handle, said second switch actuator being in electrical communication with said hot air blower so that an operator can start and stop said hot air blower during a chandelier cleaning procedure.

7. The apparatus of claim 6, further comprising:

a soap tube having a proximal end in fluid communication with a soap tank;

at least one soap-spraying nozzle formed in said cleaning head;

said soap tube having a distal end in fluid communication with said at least one soap-spraying nozzle;

a motor-driven pump for pumping soap in said soap tank through said soap tube to said at least one soap-spraying nozzle; and a third switch actuator positioned in said hollow handle, said third switch actuator being in electrical communication with said motor-driven pump so that an operator can start and stop said soap flow to said cleaning head during a chandelier cleaning procedure.

8. The apparatus of claim 2, further comprising:

an imperforate vacuum-increasing wall removably mounted between said first and second sections of said cleaning head to cause ambient air flowing into said cleaning chamber to flow at a higher rate relative to an ambient air flow rate when no imperforate wall is positioned between said first and second sections.

9. The apparatus of claim 2, further comprising:

a rounded lip disposed about a peripheral edge of each of said first and second sections so that each crystal contacting a rounded lip is further dried as water on each crystal is wicked onto said rounded lip.

10. The apparatus of claim 9, further comprising:

at least one opening formed in said rounded lip;

a sipper tube having a proximal end in fluid communication with said source of negative pressure and at least one distal end in fluid communication with said at least one opening formed in said rounded lip;

said sipper tube conveying water, dust and dirt from said at least one crystal to said dirty water and vacuum chamber.

11. The apparatus of claim 1, further comprising:

a fill port formed in said water chamber so that water can be charged into said water chamber as needed; and a drain opening formed in said water chamber to allow drainage of water from said water chamber.

12. The apparatus of claim 1, further comprising:

a drain opening formed in said dirty water and vacuum chamber to allow drainage of water from said dirty water and vacuum chamber.

13. The apparatus of claim 1, further comprising:

said hand being a human hand.

14. The apparatus of claim 1, further comprising:

said hand being a robotic hand.

* * * * *